United States Patent [19]

Stokes

[11] Patent Number: 4,502,455

[45] Date of Patent: Mar. 5, 1985

[54] BALL FEEDER FOR THROWING MACHINE

[76] Inventor: Gilbert A. Stokes, Star Rte., Mountain Ranch, Calif. 95246

[21] Appl. No.: 524,433

[22] Filed: Aug. 18, 1983

[51] Int. Cl.[3] ..... A63B 69/40; F41F 1/04

[52] U.S. Cl. ..... 124/50; 124/56

[58] Field of Search ..... 221/204, 205; 124/49, 124/50, 51 A, 56, 51 R

[56] References Cited

U.S. PATENT DOCUMENTS

| | | | |
|---|---|---|---|
| 1,012,106 | 12/1911 | Seavey | 221/204 X |
| 3,777,732 | 12/1973 | Holloway et al. | 124/50 X |
| 3,844,267 | 10/1974 | Mohr | 124/49 X |
| 3,847,132 | 11/1974 | Schatz | 124/50 X |
| 3,855,988 | 12/1974 | Sweeton | 124/56 |
| 4,116,438 | 9/1978 | Berliner | 124/51 R X |
| 4,203,413 | 5/1980 | Hodges | 124/49 X |
| 4,233,953 | 11/1980 | Bash | 124/56 |
| 4,372,283 | 2/1983 | Balka, Jr. | 124/56 |

*Primary Examiner*—Richard T. Stouffer
*Attorney, Agent, or Firm*—Littlepage & Webner

[57] ABSTRACT

Tennis balls are sequentially fed to an entranceway in the top of the plenum chamber of a pneumatic throwing machine by a flexible disk which rotates about a vertical axis. The balls roll by gravity down a chute onto the feed disk which has angularly spaced pocket holes. To prevent jamming of unpocketed balls between the top of the feed disk and the feed chute, the disk is sufficiently flexible as to be deflectable by an unpocketed ball and be discharged through an open escape path.

2 Claims, 5 Drawing Figures

BALL FEEDER FOR THROWING MACHINE

RELATED APPLICATIONS

Tennis Ball Throwing Machine, application Ser. No. 524,434, filed concurrently herewith.

FIELD OF INVENTION

Mechanical Guns and Projectors, Fluid Pressure, Means for Feeding Projectiles or Ejecting Cartridges in Class 124, subclass 82.

PRIOR ART

Stokes U.S. Pat. No. 3,990,426;
Sweeton U.S. Pat. No. 4,027,646;
Balka, Jr. U.S. Pat. No. 4,207,857; and
Bash et al. U.S. Pat. No. 4,291,665.

BACKGROUND AND OBJECTS

Rotary feed disks having angularly spaced pockets into which balls lodge when transported from a chute to a throwing machine are well-known, as is also well-known the tendency of the balls to jam against adjacent structures when an unpocketed ball is carried around on top of the disk. The object of this invention is to provide a jam-proof rotating flexible pocketed disk for receiving tennis balls from a feed chute and transporting them to an entranceway of a ball throwing machine, wherein the disk is sufficiently flexible so as to be deflected downwardly by an unpocketed ball jammed between the upper side of the disk and adjacent overlying structure, such as the feed chute. In conjunction with the disk flexibility feature it is vital that there be a clearance path through which a jammed ball may escape.

These and other objects will be apparent from the following specification and drawings in which FIG. 1 is a perspective view of the ball throwing machine in which the invention is incorporated;

Figure 1:
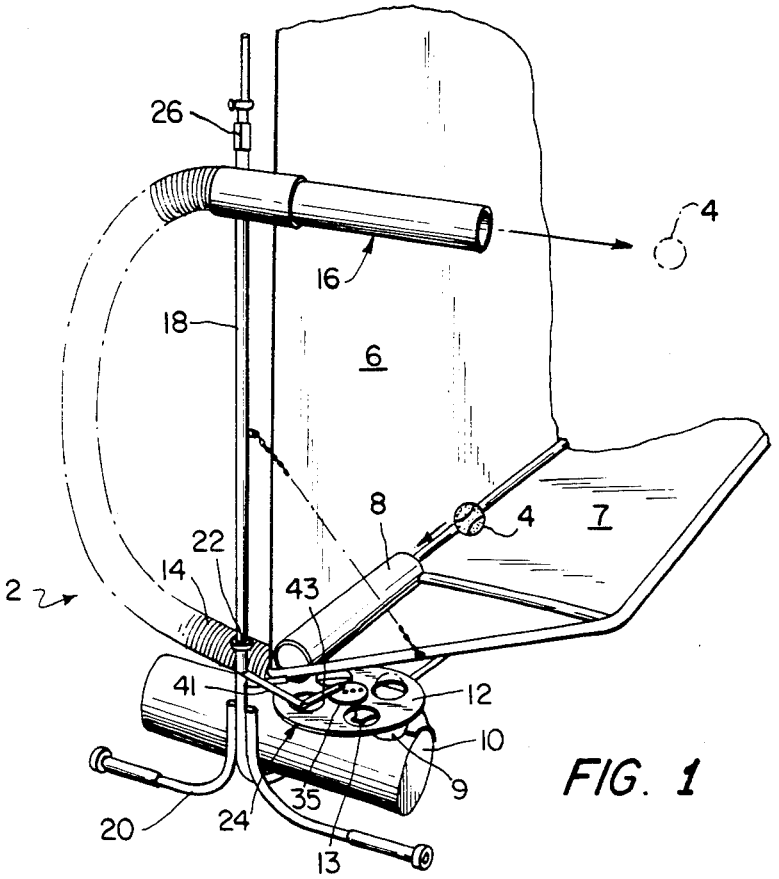
Figure 2:
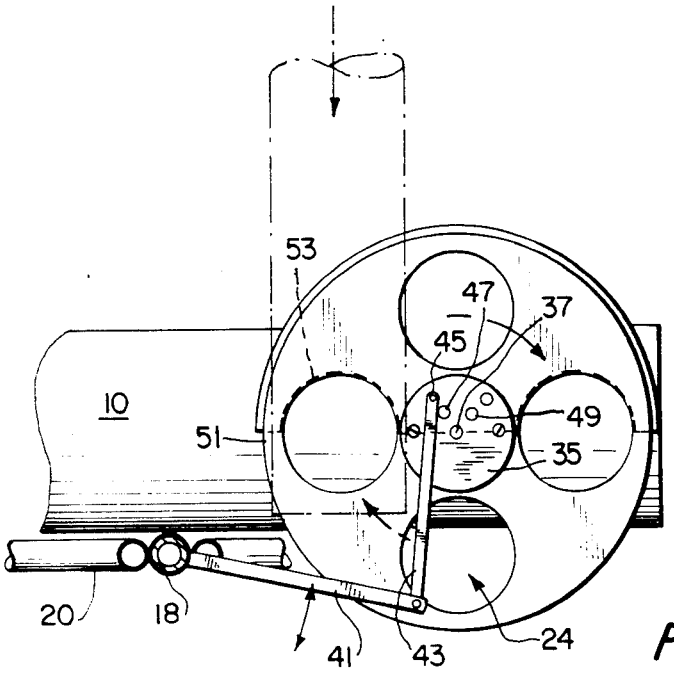
FIG. 2 is a fragmentary plan view of the ball feed mechanism.
Figure 3:
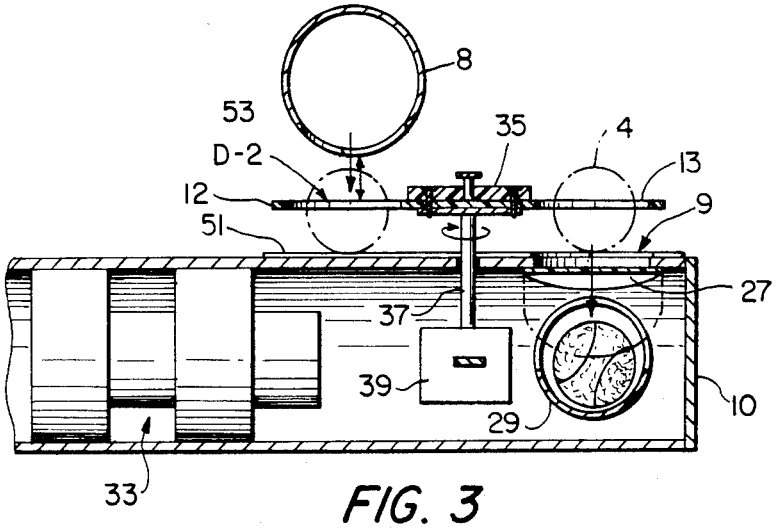
FIG. 3 is a fragmentary cross-section through an end of the pneumatic dispatcher showing the ball feed mechanism.

Referring now to the drawings in which like reference numerals denote similar elements, the tennis ball throwing machine 2 is for throwing tennis balls 4, 4' towards a player who returns them to a target 6. In front of the target is an apron 7 which collects balls which roll down a feed chute 8, e.g., a tube. The balls are fed by a feed disk 12 into the entranceway 9 of a pneumatic dispatcher 10 and are expelled therefrom via an outlet tube 31 and flexible hose 14 to a barrel 16 supported on a post 18. The post is rotatably supported on a stand 20 by a bearing 22. An oscillating mechanism 24 which is driven by feed disk 12 oscillates post 13 back and forth so as to scan the barrel to the left and right, and a clamp 26 adjustably supports barrel 16 on post 18 so that the height of the barrel may be adjusted. This invention is concerned with the feed mechanism by which the ball is transported from feed chute 8 to the entranceway 9 of the pneumatic dispatcher 10. As will be apparent from FIG. 3, the balls 4 which pass through entranceway 9 force downwardly a normally leaky flap valve 27 which gives way to let the ball drop into a catcher 29 from which it is propelled through the outlet tube which is momentarily choked sufficiently so that air from blower 33 suddenly seals the flap valve 27 against the inner sides of entranceway 9. The sudden increase in air pressure from blower 33 forceably propels the ball through tube 31, flexible hose 14 and barrel 16.

Figure 4:
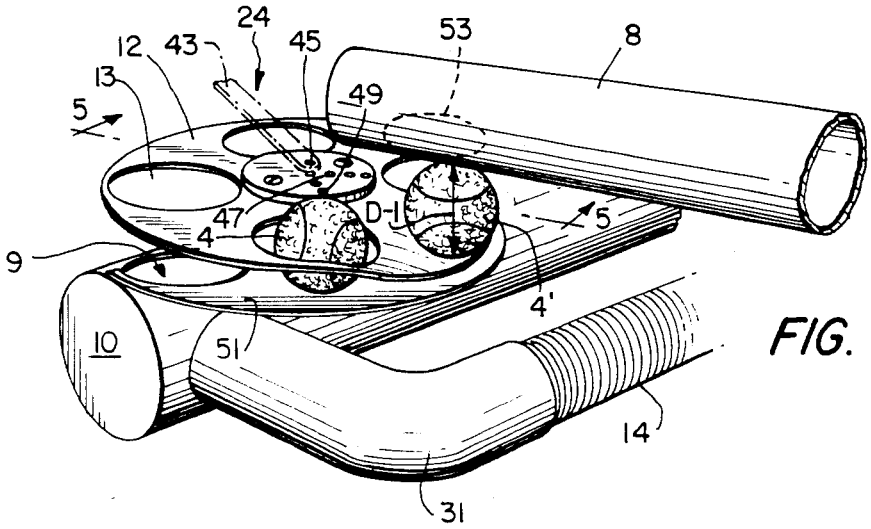
FIG. 4 is a perspective view showing the ball feed mechanism discharging an unpocketed ball.
Figure 5:
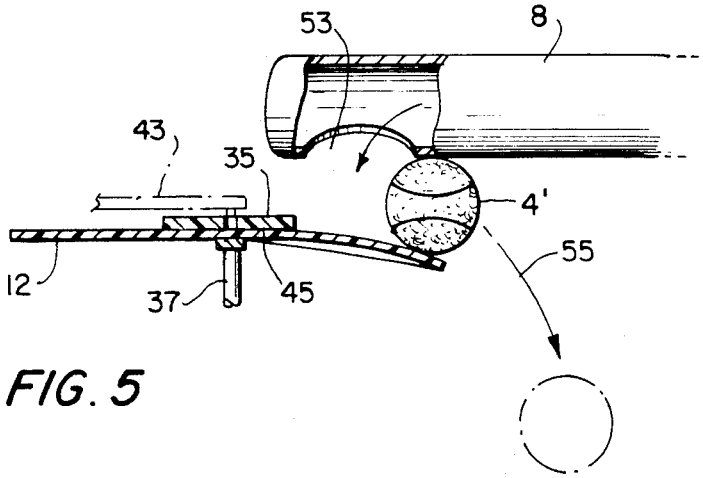
FIG. 5 is a fragmentary cross-section through the ball feed mechanism further illustrating the escape path for an unpocketed ball.

Feed disk 12 has a hub 35 affixed on the upper end of the shaft 37 of an electric motor 39 supported in the dispatcher 10. A lever 41 on post 18 is connected by a link 43 to hub 35 of the disk by means of a pin 45 which can be selectively engaged into any one of a series of holes 47, 49 of different radii from the center of the hub. By this means the extent of oscillatory movements can be varied. Spaced beneath feed disk 12 is a ball support plate 51 which supports the balls lodged in the pockets 13 as they travel along a path from beneath the downwardly open chute outlet 53 to the upwardly open entranceway 9 of the pneumatic dispatcher. To reduce the chances for a ball to escape as it leaves the chute outlet 53 to enter a pocket 13 on the disk, the distance D2 between the bottom wall of chute 8 in the region of the chute outlet 53 is considerably less and the diameter D1 of the tennis balls being fed. Therefore, if a tennis ball dropping through chute outlet 53 fails to enter a pocket 13 on the feed disk 12, the ball would most likely jam between the lower end portion of chute 8 and disk 12. To avoid this, disk 12 is made of flexible material so that it will deflect downwardly (see FIGS. 4 and 5 wherein the ball 4' has forced disk 12 downwardly) and the ball escapes via an open escape path 55 (FIG. 5) and drops harmlessly to the side of the machine so that it does not interfere with the continuous rotation of the disk 12 nor does it become jammed in the oscillating mechanism 24.

I claim:

1. A ball feeder for a tennis ball throwing machine, said ball feeder including an upwardly facing ball entranceway and a downwardly inclined ball feed chute, said ball feed chute having a lower end laterally spaced from the entranceway, a disk having a portion disposed beneath the lower end of the chute while another portion is disposed over the entranceway, said disk having at least one ball pocket extending therethrough, means for mounting said disk for rotation about a vertical axis and motor means for so rotating said disk, the disk, the lower end of the chute, and entranceway being so arranged that a tennis ball exiting from the lower end of the chute normally enters the disk pocket and is transported along an arcuate path to the entranceway, there being upwardly facing surface means spaced below said disk for supporting a pocketed tennis ball along said arcuate path, and the lower end of the chute being spaced above the upper surface of the disk by distance less than the diameter of a conventionally sized tennis ball, whereby said tennis ball when not entering a disk pocket becomes an unpocketed tennis ball riding on the disk, which unpocketed ball normally tends to jam between the disk and the chute, said disk being characterized by flexibility sufficient to permit the same to flex downwardly in response to a downward force resulting from jamming of an unpocketed tennis ball between the upper surface of the disk and the lower end of the chute, said disk being sufficiently flexible to permit a jammed unpocketed tennis ball to escape from between said upper surface and said lower end without interfering with rotation of said disk by said motor means, and space means providing a ball escape path leading latrally from the space between the lower end of the chute and the upper surface of the disk through which a jammed ball may escape.

2. The combination claimed in claim 1, said ball feed chute having a downwardly facing ball outlet opening at its lower end.

* * * * *